United States Patent [19]

Gilligan et al.

[11] 4,338,762

[45] Jul. 13, 1982

[54] PHOTOGRAPHIC FILM INSERTION APPARATUS

[75] Inventors: Patrick J. Gilligan, Bloomington; Ted G. Merry, Lindstrom, both of Minn.

[73] Assignee: Pako Corporation, Minneapolis, Minn.

[21] Appl. No.: 146,507

[22] Filed: May 5, 1980

[51] Int. Cl.[3] ..... B65B 63/02; B65B 39/00

[52] U.S. Cl. ..... 53/244; 53/259; 53/258

[58] Field of Search ..... 53/540, 435, 449, 266 A, 53/570, 469, 468, 459, 475, 520, 244, 259, 258; 271/233, 213, 198, 273

[56] References Cited

U.S. PATENT DOCUMENTS

| | | | |
|---|---|---|---|
| 2,892,295 | 6/1959 | McArthur | 53/520 |
| 3,753,330 | 8/1973 | Hujer et al. | 53/520 |
| 3,788,031 | 1/1974 | Florjancic | 53/520 |
| 4,004,340 | 1/1977 | Urban | 53/520 X |
| 4,079,576 | 3/1978 | Morrison et al. | 53/266 A |
| 4,099,362 | 7/1978 | Dorman | 53/520 |
| 4,102,029 | 7/1978 | Thompson | 53/520 X |
| 4,114,349 | 9/1978 | Jensen et al. | 53/520 X |
| 4,135,343 | 1/1979 | Urban et al. | 53/520 X |
| 4,139,978 | 2/1979 | Jensen et al. | 53/266 A X |
| 4,139,980 | 2/1979 | Larson et al. | 53/520 |

*Primary Examiner*—Horace M. Culver

*Attorney, Agent, or Firm*—Kinney, Lange, Braddock, Westman and Fairbairn

[57] ABSTRACT

A photographic film insertion apparatus inserts photographic film segments into an insertion opening of a multi-layer package strip. A film conveyor conveys cut photographic film segments along a path and discharges the photographic film segments from a discharge end of the conveyor to the film insertion opening. After the film segments have been conveyed into the insertion opening, a film pushing element drives the film segments a further distance into the insertion opening. This ensures that all film segments are securely within the insertion opening and will not hang up or tip as the multi-layer package strip is advanced away from the film insertion station.

12 Claims, 9 Drawing Figures

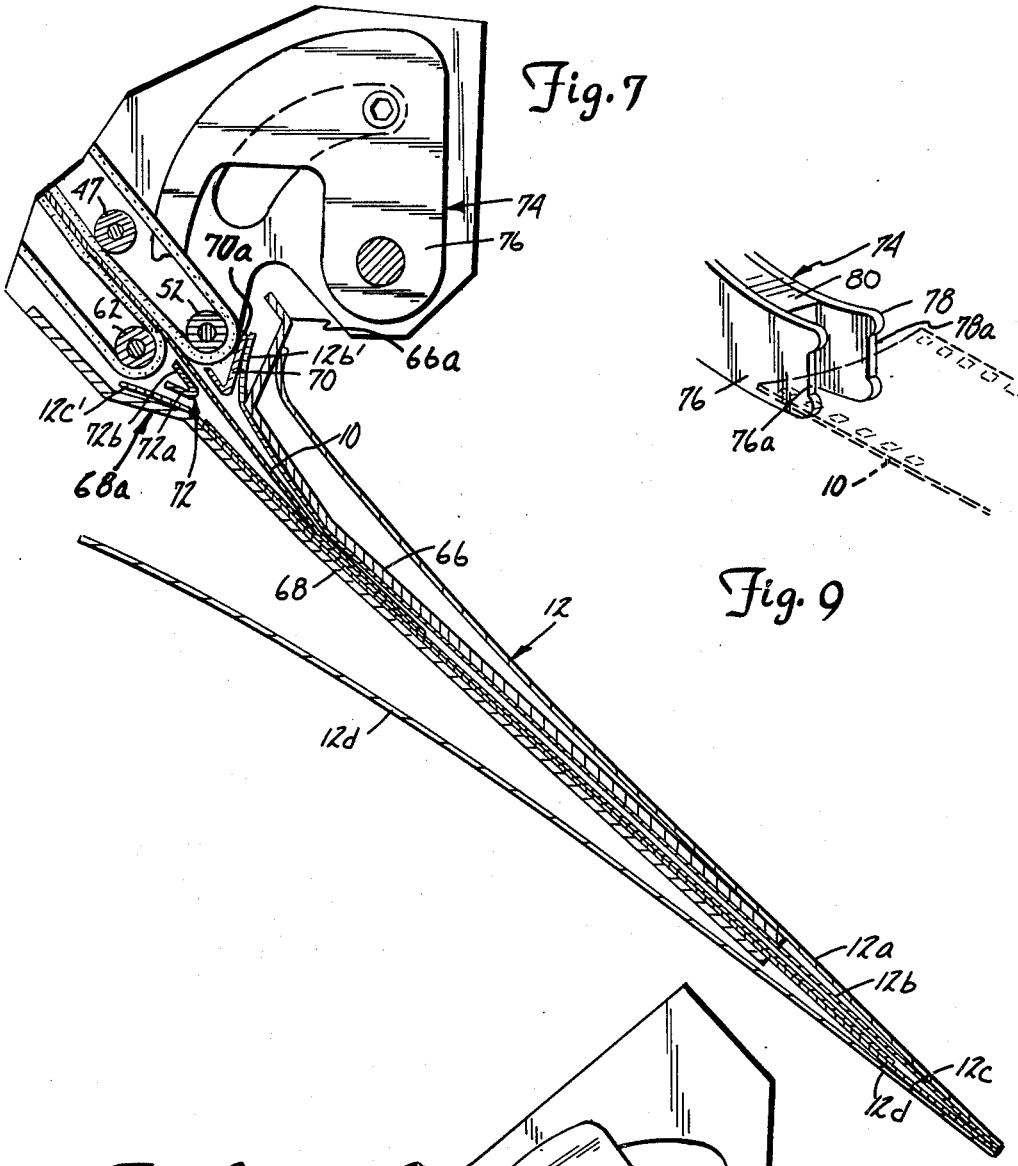
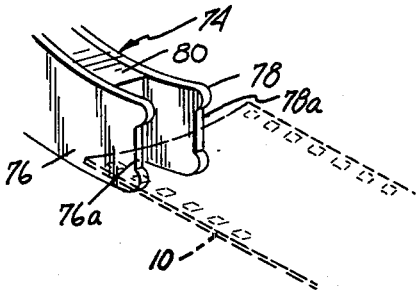
Fig. 9
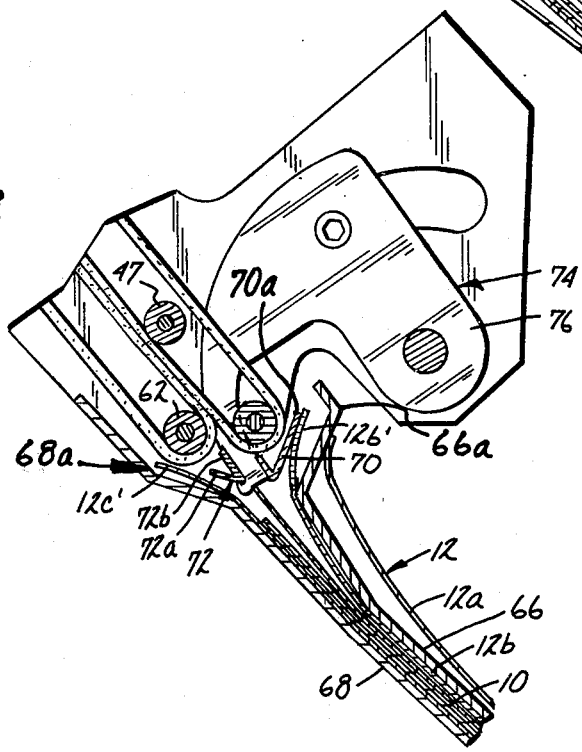

PHOTOGRAPHIC FILM INSERTION APPARATUS

REFERENCE TO COPENDING APPLICATIONS

Reference is made to a copending patent application by Armer J. Willenbring, Warren J. Osby and Gerald R. Strunc entitled "Photographic Film Packing Apparatus" filed on even date herewith and assigned to the same assignee as the present invention.

BACKGROUND OF THE INVENTION

1. Field of the Invention

The present invention relates to photographic packing equipment.

2. Description of the Prior Art

In commercial photographic processing operations, very high rates of processing must be achieved and maintained in order to operate profitably. For that reason, many rolls (or strips) of photographic film from various customers are typically spliced together for processing and printing purposes. After prints have been made from the photographic film, an individual customer's film must be separated from the large roll of film formed by the spliced-together film strips. Typically, the customer's film is cut into segments (or strips) of several frames each so that the segments can be placed flat in an envelope together with the customer's prints.

In the past, equipment has been developed to eliminate many of the operations required for cutting the film segments. One particularly advantageous apparatus, which automates film cutting, print paper cutting, print sorting, and packaging is known as the Pako Photopacker, manufactured by Pako Corporation, the assignee of the present application. U.S. Pat. Nos. 4,114,349 by G. A. Jensen, L. A. Larson and R. E. Diesch; 4,139,978 by G. A. Jensen and A. J. Willenbring; and 4,139,980 by L. A. Larson and R. E. Diesch illustrate portions of mechanisms which have been used in the Pako Photopacker. The film cutting, conveying and packing mechanism is illustrated in FIG. 3 of U.S. Pat. No. 4,139,978, and is described in further detail in U.S. Pat. No. 4,139,980.

In the apparatus shown in the above mentioned U.S. patents, a multi-layer packaging strip is transported along a transversely inclined conveyor bed (best shown in U.S. Pat. No. 4,139,978). The individual layers of the multi-layer packaging strip are separated from one another as the strip passes a film and print insertion station. The packaging strip is stopped at the film and print insertion station, and film segments are power driven by a film inserting mechanism into an opening between separated layers of the packaging strip. Similarly, the photographic prints are inserted into another opening created between other separated layers of the packaging strip. After the film and prints have been inserted, the packaging strip is advanced along the conveyor bed to other stations, at which the sides of envelopes to be formed from the continuous multi-layer packaging strip are sealed. An envelope side cutting assembly is positioned downstream of the side sealing apparatus, and cuts the sides of the envelopes along transverse separation lines. An envelope top sealing apparatus is also provided to seal the top of the envelope. The apparatus, therefore, provides sealed envelopes containing the customer's prints, the film segments from which those prints were made, and, in some cases, advertising materials or the like.

SUMMARY OF THE INVENTION

The present invention is an improved method and apparatus for inserting photographic film segments into an insertion opening of a multi-layer package strip. In the present invention, means are provided for separating layers of the package strip to form a film insertion opening. Film conveyor means convey cut photographic film segments along a path into the film insertion opening. The apparatus of the present invention further includes means for driving the film segments a further distance into the insertion opening after the conveyor means has completed conveying the film segments.

In the preferred embodiments of the present invention, the means for driving the film segments is normally positioned out of the path of the photographic film segments being conveyed. When actuated, the means moves into the path and engages trailing edge (or edges) of one or more film segments to drive the segment or segments a further distance into the film insertion opening.

BRIEF DESCRIPTION OF THE DRAWINGS

FIGS. 7 and 8 are partial sectional views along section 2—2 showing film segments being inserted between layers of a multilayer packaging strip.

FIG. 9 is a perspective view illustrating operation of the film pushing element of the present invention.

DETAILED DESCRIPTION OF THE PREFERRED EMBODIMENTS

In the following detailed description, a preferred embodiment of the apparatus of the present invention is described which is advantageously used in conjunction with the Pako Photopacker. Reference may be made to U.S. Pat. No. 4,139,978 for a more detailed description of the apparatus with which the present invention is used. Reference may also be made to U.S. Pat. No. 4,139,980, which represents a film conveying and packing mechanism previously used with the Pako Photopacker and which the apparatus of the present invention preferably replaces. In the present invention, segments or strips of film of several frames each are cut from a web 10 of photographic film. The film segments corresponding to a particular customer's order are conveyed downward and are inserted into an insertion opening formed by layers **12*b* and 12*c* of a multi-layer packaging strip 12 (see FIGS. 7 and 8**).

In the Pako Photopacker, multi-layer packaging strip 12 is transported along a transversely inclined conveyor bed (not shown in this application, but shown in U.S. Pat. No. 4,139,978). The individual layers of strip 12 are separated from one another as the strip passes a film and print insertion station, and photographic prints and film segments are inserted into openings created between the separated layers of packaging strip 12.

In the following detailed description, and in particular that portion of the description relating to FIGS. 3–6, a film packing apparatus is described in which photographic film segments are severed from film web 10, are partially overlapped, and are driven between layers of multi-layer packaging strip 12 in partially overlapping relationship. This portion of the apparatus is also described and is claimed in the previously mentioned copending application by Armer J. Willenbring, Warren J. Osby and Gerald R. Strunc, entitled "Photographic Film Packing Apparatus". The present invention, which includes means for driving the photographic film segments a further distance into the insertion opening after they have been conveyed by the film conveyor apparatus is shown generally in FIGS. 1 and 2 and in further detail in FIGS. 7–9. It should be understood that the apparatus of the present invention can be used in conjunction with film conveyor apparatus other than that specifically shown and described in this specification. For example, the present invention is also usable in conjunction with the prior art film conveying and packing mechanism shown in U.S. Pat. No. 4,139,980. The present invention is, however, particularly advantageous when used in conjunction with the apparatus of the previously mentioned copending application.

Figure 1:
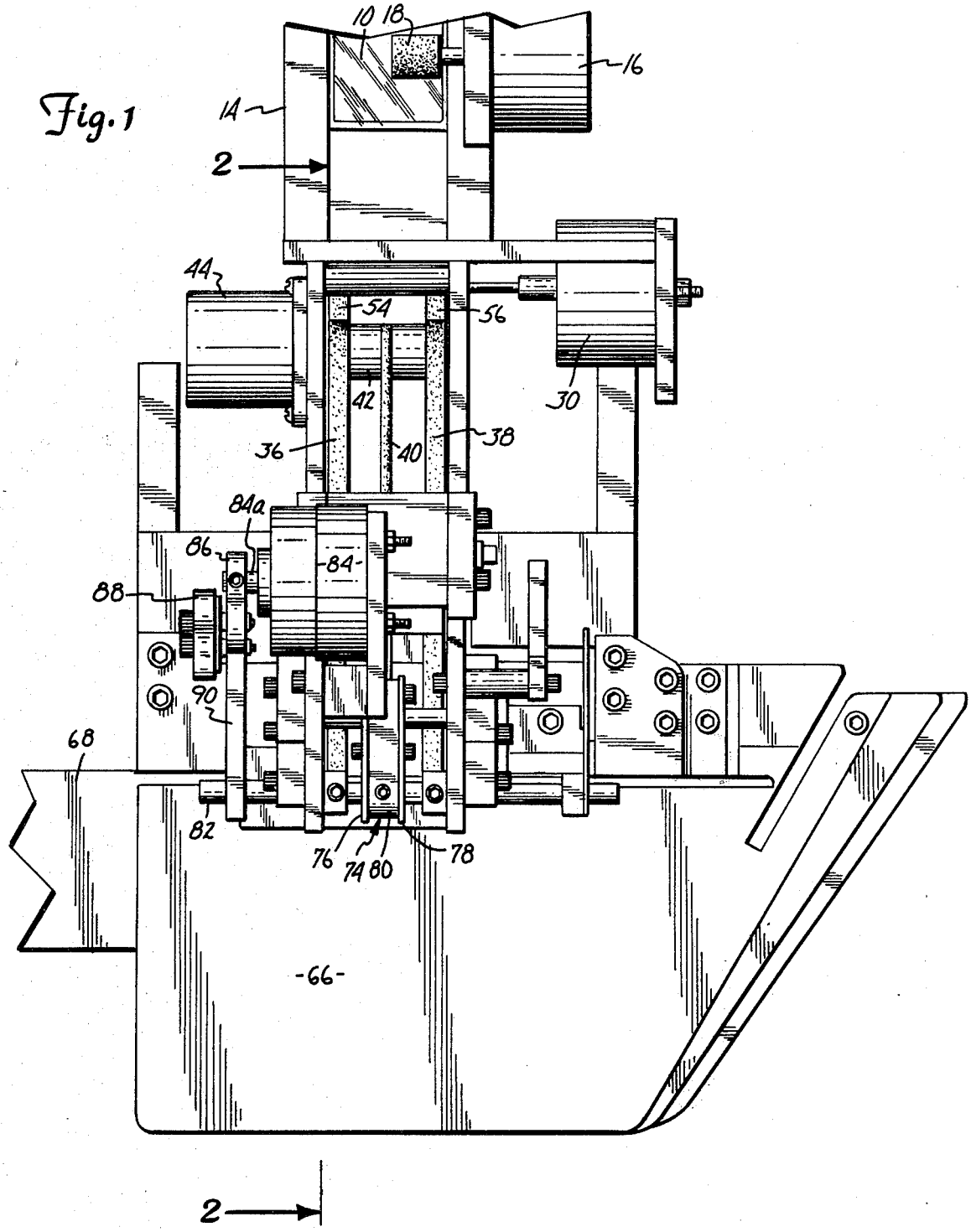
FIG. 1 is a plan view of film cutting, conveying, and inserting apparatus which utilizes the present invention.
Figure 2:
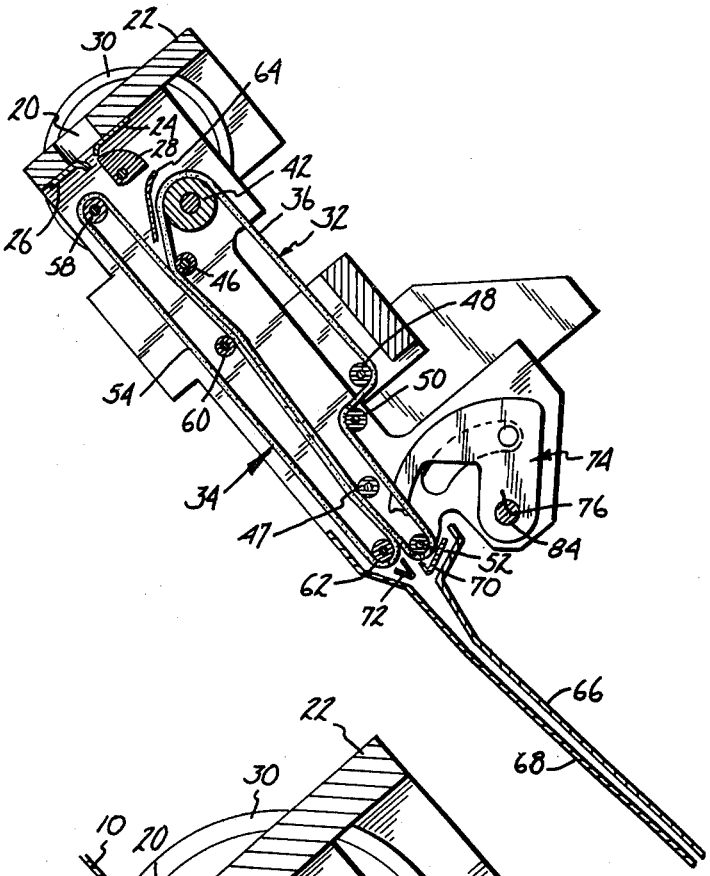
FIG. 2 is a sectional view generally along section 2—2 of FIG. 1.

At the upper end of the apparatus shown in FIGS. 1 and 2, a film guiding track 14 guides film web 10 generally downward. Stepper motor 16 drives roller 18, which advances film web 10 downward.

As film web 10 is advanced downward, it passes through opening 20 in plate 22 and through an opening formed by deflector 24 and fixed knife blade 26. Rotatable knife blade 28, which is driven by rotary solenoid 30, cooperates with fixed blade 26 to sever film segments from film web 10.

A conveyor section of the apparatus includes an upper conveyor belt assembly 32 and a lower conveyor belt assembly 34. Upper conveyor belt assembly 32 includes a pair of conveyor belts 36 and 38, timing belt 40, belt drive stepper motor 44, and idler rollers 46, 47, 48, 50 and 52. Lower conveyor belt assembly 34 includes conveyor belts 54 and 56, and idler rollers 58, 60 and 62.

As shown in FIG. 2, the receiving end of lower belt assembly 34 is more closely positioned to the knife location (defined by fixed blade 26) than is the receiving end of the upper belt assembly 32. Drive roller 42 and idler roller 46 of upper assembly 32 are positioned so that the portion of the belt run between rollers 42 and 46 is inclined with respect to the run of the lower belts between idler roller 58 and 60. Deflector 64 is positioned to deflect the leading edges of film 10 into the nip defined by upper belts 36 and 38 and lower belts 54 and 56.

Cut film segments are conveyed by upper and lower conveyor assemblies 32 and 34 generally downward and inserted between separated layers of packaging strip 12. As shown in FIGS. 7 and 8, separators 66 and 68, and members 70 and 72 separate layers **12*b* and 12*c* of packaging strip 12 to define an insertion opening into which the cut film segments from film strip 10 are inserted. For ease of illustration, packaging strip 12 is not shown in FIGS. 1 and 2, but is shown in FIGS. 7 and 8. The operation of separators 66 and 68, and members 70 and 72 is further illustrated in FIGS. 7 and 8**.

The film insertion apparatus of the present invention preferably comprises a rotatable film pusher 74 which has a pair of film engaging arms 76 and 78 which are spaced from one another in generally parallel relationship by spacer 80. As shown in FIG. 2, film pusher 74 is in its normal, retracted position out of the path of the film segments. Pusher 74 is fixedly attached to rotatable shaft 82, which is driven by a rotary solenoid 84 through link arms 86, 88 and 90. Link arm 86 has one end fixedly attached to shaft **84*a* of solenoid 84, and has its opposite end pivotally connected to arm 88. The opposite end of arm 88 is pivotally connected to one end of arm 90, and the other end of arm 90 is fixedly connected to shaft 82. When solenoid 84 is actuated, it causes shaft 82 to rotate, thereby rotating arms 76 and 78 of film pusher 74 to engage the trailing edge of any film segment which is not fully inserted into the envelope defined by layers 12*b* and 12*c* of packaging strip 12**.

The film pusher 74 of the present invention ensures that all film segments are out of contact with the film insertion apparatus and are securely within the insertion opening between layers **12*b* and 12*c* before packaging strip 12 is advanced along the conveyor bed to further stations. This ensures that the film segments will not hang up or tip as the packaging strip is advanced. In some cases, if the film segments tip or hang up, they will interfere with subsequent operations, such as sealing and cutting envelopes from packaging strip 12**. The present invention, therefore, increases reliability of the apparatus by eliminating problems which could be caused by film segments hanging up or tipping.

The operation of the film cutting, conveying and inserting apparatus is illustrated in FIGS. 3–9.

Figure 3:
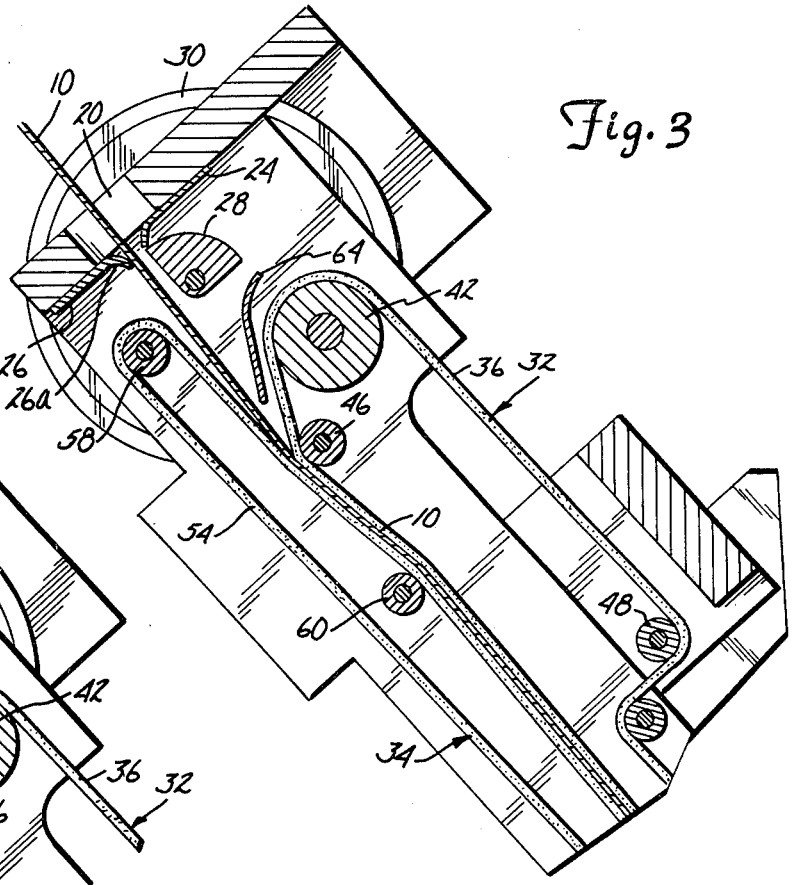
Figure 4:
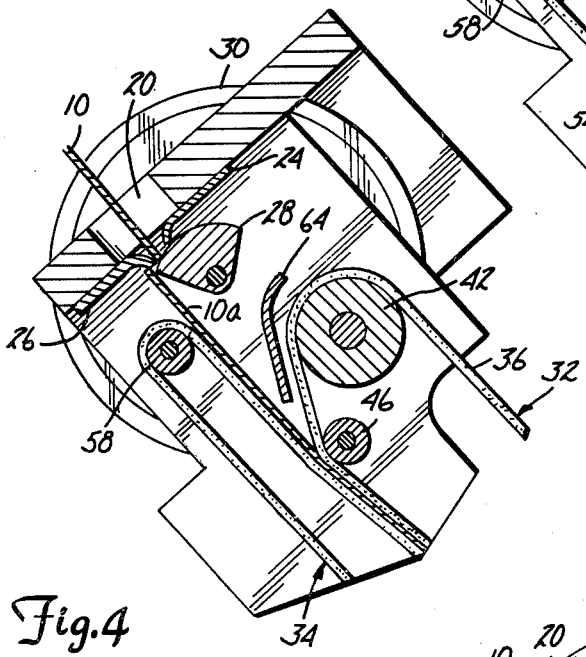

FIG. 3 shows the beginning of the operation of the apparatus for a new customer order. Web 10 is advanced by stepper motor 16 (shown in FIG. 1) through opening 20 and past the knife location defined by fixed knife blade 26. Web 10 continues to be advanced until its leading edge reaches the nip defined by upper belts 36 and 38 and lower belts 54 and 56. At this point, stepper motor 44 is actuated to drive belts 36 and 38 at the same rate that stepper motor 16 is driving film 10. Stepper motors 16 and 44 are driven synchronously until a desired length of web 10 has been advanced past fixed blade 26. At this point, both stepper motor 16 and stepper motor 44 are stopped, and rotary solenoid 30 is actuated. Movable blade 28 rotates into engagement with fixed blade 26 and severs film segment 100 from web 10, as illustrated in FIG. 4.

While movable blade 28 remains in engagement with fixed blade 26, stepper motor 44 is actuated to drive belts 36 and 38 in reverse, thereby causing the trailing edge of segment 100 to be deflected downward by curved portion **26*a* of fixed blade 26. This ensures that the trailing edge of segment 100 is out of the path of the leading edge of web 10**.

Figure 5:
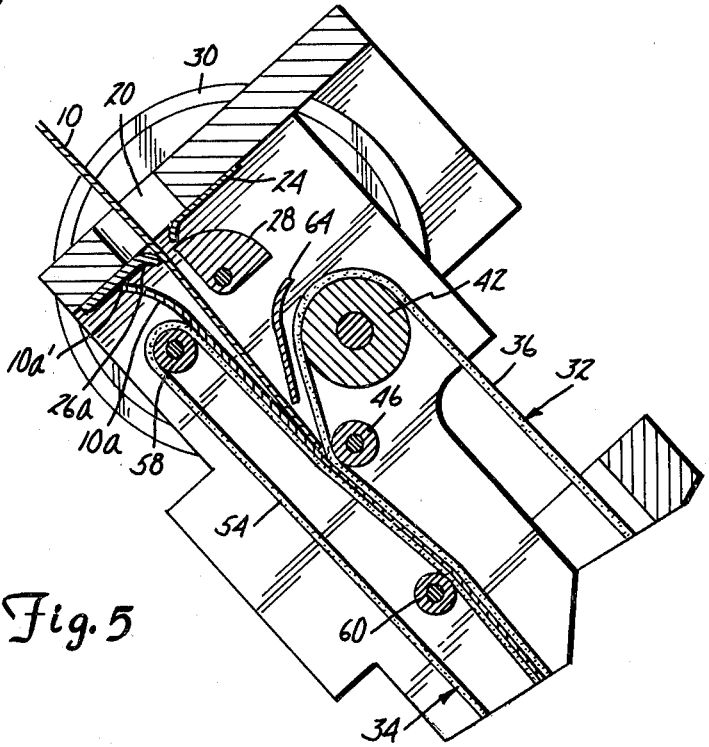

As shown in FIG. 5, web 10 is then advanced by stepper motor 16 until the leading edge of web 10 reaches the nip defined by the upper and lower conveyor belt assemblies 32 and 34. During this advancement of web 10, upper belt assembly 32 is not driven by motor 44, and therefore film segment 100 does not advance downward. This permits a portion of web 10 to overlap segment 100.

Figure 6:
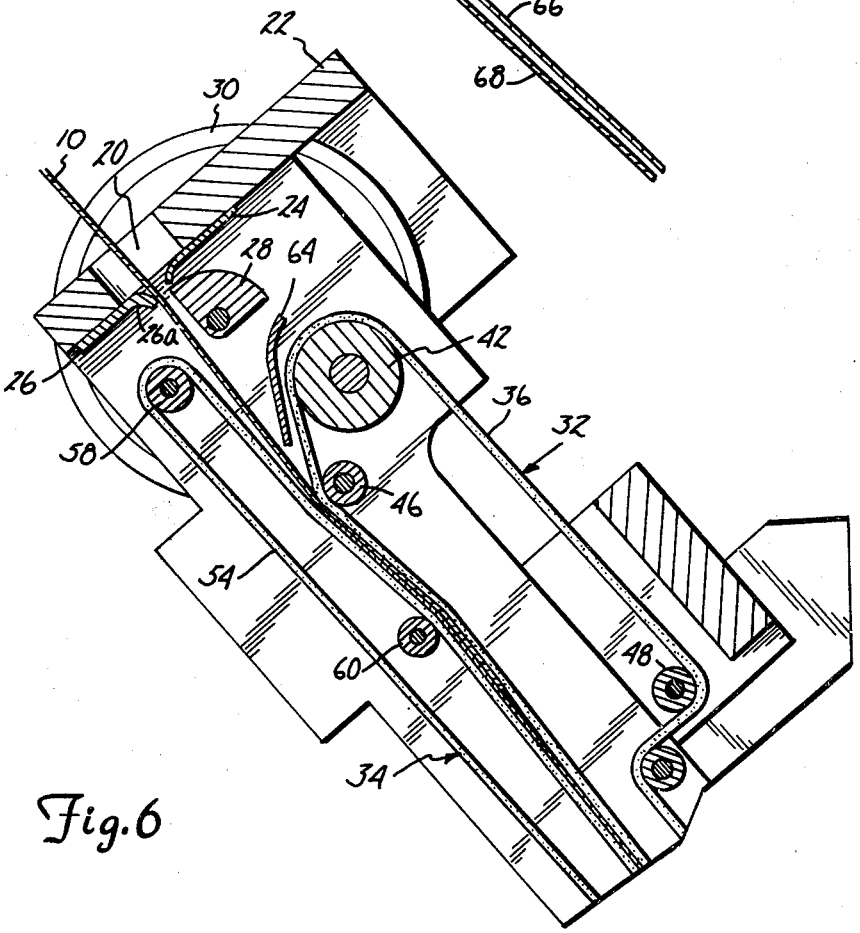
FIGS. 3 through 6 are partial sectional views generally along section 2—2 showing the apparatus of the present invention in operation advancing a film web past a cut location, cutting a first segment from a film web, partially overlapping the first segment with the web, and advancing the web and the first segment together in partially overlapping relationship.

In the next stage of operation, as illustrated in FIG. 6, motor 44 is driven in synchronism with motor 16, so that web 10 and film segment 100 are driven in overlapping relationship through the conveyor portion of the apparatus defined by conveyor belt assemblies 32 and 34. As illustrated in FIG. 6, the distance by which web 10 overlaps cut film segment 100 is determined by the distance by which film segment 100 has been backed up after cutting, and the distance web 10 has been advanced before motor 44 begins to drive upper conveyor belt assembly 32.

The process illustrated in FIGS. 3–6 is repeated as many times as is necessary in order to cut all of the segments of web 10 corresponding to a particular customer's order. In each case, the previously cut segment 100 is backed up and then maintained stationary while web 10 is advanced to overlap the previously cut film segment 100. Once the desired amount of overlap has been achieved, motor 44 is driven in synchronism with motor 16 to drive web 10 and previously cut film segment 100 together in overlapping relationship toward the discharge end of conveyor belt assemblies 32 and 34.

FIG. 7 shows the cut film segments 100 as they are deposited into an insertion opening formed in envelope strip 12. As illustrated in FIG. 7, envelope strip 12 includes four layers 12*a*, 12*b*, 12*c* and 12*d*. Separators 66 and 68 separate layers 12*b* and 12*c* to form the opening into which the cut film segments 100 are inserted. The upper end 12*b*′ of layer 12*b* is fed between upturned flange 66*a* of separator 66 and portions 70*a* of member 70. The upper end 12*c*′ of layer 12*c* is fed between flange portion 68*a* of separator 68 and portions 72*a* of member 72. It can be seen, therefore, that layers 12*b* and 12*c* are held apart at their upper ends 12*b*′ and 12*c*′ to create an insertion opening into which film segments 100 are driven.

As illustrated in FIG. 7, segments 100 are driven in an overlapping relationship by belt assemblies 32 and 34 generally downward into the insertion opening. As illustrated in FIG. 7, idler rollers 52 and 62 are positioned so that driven belts 36 and 38 slightly overhang lower belts 54 and 56 respectively. Once one segment has been driven out of contact with belts 36 and 38, the partially overlapping segment above it continues to be driven. Member 70 is positioned proximate belts 36 and 38 at the discharge end of the conveyor system. Similarly, member 72 is positioned proximate belts 54 and 56 at the discharge end of the conveyor system. Portions 70*b* of member 70 and portions 72*b* of member 72 contain the trailing edge of the last segment 100 conveyed (if not all segments) in a position to ensure engagement by pusher arms 76 and 78. This allows pusher arms 76 and 78 to sweep through a center opening (not shown) in members 70 and 72 and clear the segments from the film discharge area and drive the segments a final distance into the insertion opening.

After the final film segment 100 of a customer's order has been fed between layers 12*b* and 12*c*, solenoid 84 is actuated, which rotates shaft 82 and moves pushing arms 76 and 78 of pusher 74 downward to engage and push the trailing edges of film segments. This operation is shown in FIGS. 8 and 9. By actuating pusher 74, film segments 100 are driven out of any possible contact with conveyor belts 36 and 38 and members 70 and 72. As a result, all film segments 100 are in proper position between layers 12*b* and 12*c*, and will not hang up or tip as packaging strip 12 is advanced along the conveyor bed to further stations where each envelope is sealed on its sides and top and severed from packaging strip 12.

In a preferred embodiment of the present invention, as best illustrated in FIG. 9, arms 76 and 78 of pusher 74 have notches 76*a* and 78*a*, respectively, at their film pushing ends. Notches 76*a* and 78*a* help to ensure that reliable pushing contact will be made with the trailing edges of film segments 100, despite slight variations in the positions of the trailing edges.

Although the present invention has been described with reference to preferred embodiments, workers skilled in the art will recognize that changes may be made in form and detail without departing from the spirit and scope of the invention.

What is claimed is:

1. A photographic film inserting apparatus for inserting photographic film segments into an insertion opening of a multi-layer package strip and stacking the film segments into a film stack between a pair of the layers of the package strip, the apparatus comprising:

means for separating layers of the package strip to form a film insertion opening at a film inserting and stacking station;

film conveyor means for conveying cut photographic film segments along a film path into the film insertion opening; and means for driving any film segment not fully inserted into the multi-layer package strip a further distance into the insertion opening after the film conveyor means has completed conveying the film segments onto the film stack, by engaging a trailing edge of any film segment not fully inserted into the multi-layer package strip, the further distance being sufficient to avoid interference between the film conveyor means and the trailing edges of the stacked film segments as the multi-layer package strip with inserted stacked film segments is advanced away from the film inserting and stacking station, said means for driving comprising:

pusher means for pushing the trailing edge of any film segment not fully inserted into the multi-layer package strip, the pusher means being rotatable angularly from a normal position out of the film path to a position in which the pusher means pushes the trailing edge and having a trailing edge engaging surface sufficiently large to compensate for variations in the position of the trailing edge;

actuator means for rotating the pusher means to cause the pusher means to push the trailing edge; wherein the actuator means is actuated after all the film segments of a customer order have been conveyed by the film conveyor means and stacked in the film stack, and before the package strip and the stacked film segments are advanced away from the film inserting and stacking station.

2. The apparatus of claim 1 wherein the means for driving comprises a plurality of spaced apart film pushing arms.

3. The apparatus of claim 2 wherein the film pushing arms each have a film engaging portion for engaging the trailing edge of the segment to push the segment into the insertion opening.

4. The apparatus of claim 3, wherein the film engaging portion comprises a film engaging notch at the end of the pushing arm.

5. The apparatus of claim 1 wherein the film conveyor means has a discharge end positioned proximate an entrance end of the insertion opening.

6. The apparatus of claim 5 and further comprising means proximate the discharge end for maintaining the trailing edge of the film segment in a predetermined location.

7. The apparatus of claim 6 wherein the means for driving is normally positioned out of the path and when actuated moves through the predetermined location to engage and push the trailing edge of the segment.

8. In a photographic film packing apparatus of the type in which a continuous multi-layered packaging strip is advanced along a conveyor having a plurality of stations, and in which layers of the packaging strip are separated at a film insertion station to create an insertion opening, and in which film conveyor means convey a plurality of cut photographic film segments along a film path and discharge the film segments from a discharge end into the insertion opening and stack the plurality of film segments between layers of the packaging strip in a film stack, the improvement comprising:

means for driving any film segment not fully inserted into the multi-layered packaging strip a further distance into and past the insertion opening after the photographic film segment has been discharged, wherein the further distance is sufficient to avoid interference between the film packing apparatus and the film segments of the film stack as the packaging strip is advanced from the film insertion station, the means for driving including a plurality of spaced apart rotatable film pushing arms normally positioned out of the film path, and when actuated, rotating in an angular direction into the film path to engage a trailing edge of any film segment not fully inserted into the multi-layered packaging strip to push the film segment a further distance onto the film stack, the film pushing arms each have a film engaging portion for engaging the trailing edge of the film segment to push the film segment into the insertion opening, the film engaging portion having a film engaging notch at the end of the pushing arm, and wherein the means for driving is actuated after all the film segments of a customer order have been conveyed by the film conveyor means and before the packaging strip and the film stack are advanced away from the film insertion station.

9. The invention of claim 8 and further comprising means proximate the discharge end for maintaining the trailing edge of the film segment in a predetermined location.

10. The invention of claim 9 wherein the means for driving is normally positioned out of the path and when actuated moves through the predetermined location to engage and push the trailing edge of the segment.

11. The invention of claim 8 wherein the means for driving further comprises:

actuator means for moving the pusher arms to cause the pusher arms to push the trailing edge.

12. The apparatus of claim 11 wherein the actuator means rotates the pusher arms.

* * * * *